US006389108B1

(12) United States Patent
Ein-Gal

(10) Patent No.: US 6,389,108 B1
(45) Date of Patent: May 14, 2002

(54) MOVING COLLIMATOR SYSTEM

(76) Inventor: Moshe Ein-Gal, 30 Azar Street, Ramat Hasharon 47203 (IL)

( * ) Notice: Subject to any disclaimer, the term of this patent is extended or adjusted under 35 U.S.C. 154(b) by 0 days.

(21) Appl. No.: 09/497,362

(22) Filed: Feb. 3, 2000

(30) Foreign Application Priority Data

Feb. 3, 1999 (IL) ..... 128363

(51) Int. Cl.[7] ..... G21K 1/02

(52) U.S. Cl. ..... 378/147; 378/148; 378/149; 378/150; 250/505.1

(58) Field of Search ..... 378/147, 148, 378/149, 146, 150, 160; 250/505.1; 359/641

(56) References Cited

U.S. PATENT DOCUMENTS 2,730,566 A * 1/1956 Bartow et al. ..... 378/98.6
3,749,911 A * 7/1973 Hoover et al. ..... 378/146
3,869,615 A * 3/1975 Hoover et al. ..... 378/146
4,241,404 A * 12/1980 Lux ..... 378/2
4,288,697 A * 9/1981 Albert ..... 250/505.1
4,419,585 A * 12/1983 Strauss et al. ..... 250/505.1
4,465,540 A * 8/1984 Albert ..... 156/252
4,493,098 A * 1/1985 Riihimäki et al. ..... 378/146
4,773,087 A * 9/1988 Plewes ..... 378/146
5,050,199 A * 9/1991 Watanabe ..... 378/146
5,165,106 A 11/1992 Barthelmes et al. ..... 250/505.1
5,189,687 A 2/1993 Bova et al. ..... 378/65
5,436,958 A * 7/1995 Taylor ..... 378/149
5,757,886 A 5/1998 Song ..... 378/147

FOREIGN PATENT DOCUMENTS

JP 6-233831 8/1994

* cited by examiner

*Primary Examiner*—Robert H. Kim
*Assistant Examiner*—Allen C. Ho
(74) *Attorney, Agent, or Firm*—Dekel Patent Ltd.; David Klein

(57) ABSTRACT

A collimator system including a plurality of revolvable plates stacked one above another, the plates being constructed of a material substantially impervious to passage therethrough of radiation in a predetermined range of wavelengths, and at least one collimator aperture formed in each of the plates.

11 Claims, 6 Drawing Sheets

MOVING COLLIMATOR SYSTEM

FIELD OF THE INVENTION

The present invention relates generally to stereotactic radiotherapy apparatus and particularly to a revolving or moving stack of collimators for shaping a radiation beam for performing stereotactic radiotherapy.

BACKGROUND OF THE INVENTION

In stereotactic radiotherapy, a radiation source produces a radiation beam for irradiating a target tissue. A collimator is generally placed at the outlet end of the radiation source in order to shape the radiation beam to a desired diameter. In certain radiotherapy treatment plans, it may be required to irradiate the target tissue with several different diameter radiation beams. This generally requires dismantling a first collimator and replacing it with a second collimator of a different diameter and so forth. Such a procedure is inconvenient and time-consuming.

There are systems with multiple collimators in the prior art. Japanese Patent Document 6-233831 assigned to Hitachi describes a collimator revolver on which several numbers of collimators can be mounted. The collimator revolver is located near a collimator head of a radiotherapy device. The collimator head has a sliding mechanism which can grasp one of the collimators from the collimator revolver and slide the selected collimator into position on the collimator head so that the selected collimator is aligned with a radiation source.

U.S. Pat. No. 5,757,886 to Shipeng Song describes a system in which a plurality of radioactive sources are mounted in a base wherein all of the sources are radially aligned with a common focus on the central axis of the base. Coaxially aligned with the central axis is a collimator base containing a plurality of collimators of different aperture diameter. The collimator base can be rotated about the central axis so as to selectively align a particular collimator with one of the radiation sources.

SUMMARY OF THE INVENTION

The present invention seeks to provide a novel revolving collimator system which can shape a radiation beam emanating from a radiation source with a plurality of mutually alignable collimators and pre-collimators. The collimators and pre-collimators are mounted on a revolving plates preferably stacked along a common axis like a "lazy susan". A control system with servomotors selectively rotates any of the collimator plates, thereby aligning a plurality of collimators to form a path for collimating a radiation beam. The present invention thus collimates and pre-collimates radiation beams over a wide range of diameter apertures suitable for virtually any kind of radiotherapy treatment plan.

There is thus provided in accordance with a preferred embodiment of the present invention a collimator system including a plurality of revolvable plates stacked one above another, the plates being constructed of a material substantially impervious to passage therethrough of radiation in a predetermined range of wavelengths, and at least one collimator aperture formed in each of the plates.

In accordance with a preferred embodiment of the present invention the plates are arranged relative to each other such that the collimator apertures formed in neighboring plates are alignable with each other to form a collimation path adapted for a radiation beam to pass therethrough.

Further in accordance with a preferred embodiment of the present invention the plates are arranged to revolve about a common axis.

Still further in accordance with a preferred embodiment of the present invention one of the collimator apertures on one of the plates has a different sized opening than a collimator aperture on another of the plates.

Additionally in accordance with a preferred embodiment of the present invention at least one of the plates is formed with a plurality of differently sized collimator apertures.

In accordance with a preferred embodiment of the present invention at least one of the plates is formed with a plurality of generally equally sized collimator apertures.

Further in accordance with a preferred embodiment of the present invention at least one of the plates has a thickness different from another of the plates.

Still further in accordance with a preferred embodiment of the present invention a gap between neighboring plates of the plurality of revolvable plates is sufficiently small such that a radiation beam of a predetermined wavelength is substantially prevented from passing through the gap.

Additionally in accordance with a preferred embodiment of the present invention a controller is connected to the plates which selectively revolves the plates.

In accordance with a preferred embodiment of the present invention the controller includes a servomotor linked to the plates which selectively revolves the plates.

Further in accordance with a preferred embodiment of the present invention a subset of the plates are mechanically linked together and are mounted on bearings about a common axle, such that the subset of plates revolves together independently of the other plates.

Still further in accordance with a preferred embodiment of the present invention a stop mechanism selectively arrests rotational movement of the plates.

BRIEF DESCRIPTION OF THE DRAWINGS

The present invention will be understood and appreciated more fully from the following detailed description, taken in conjunction with the drawers in which.

DETAILED DESCRIPTION OF A PREFERRED EMBODIMENT

Reference is now made to FIGS. 1–5 which illustrate a collimator system 10 constructed and operative in accordance with a preferred embodiment of tie present invention.

Collimator system 10 preferably includes a plurality of revolvable plates 12A–12H stacked one above another. It is appreciated that this is just one example of the collimator system and that any other number of plates can be employed to carry out the present invention. Plates 12A–12H are preferably formed of a material substantially impervious to passage therethrough of radiation in a predetermined range of wavelengths, such as tungsten which is generally impervious to radiation used in most types of radiotherapy.

Figure 1:
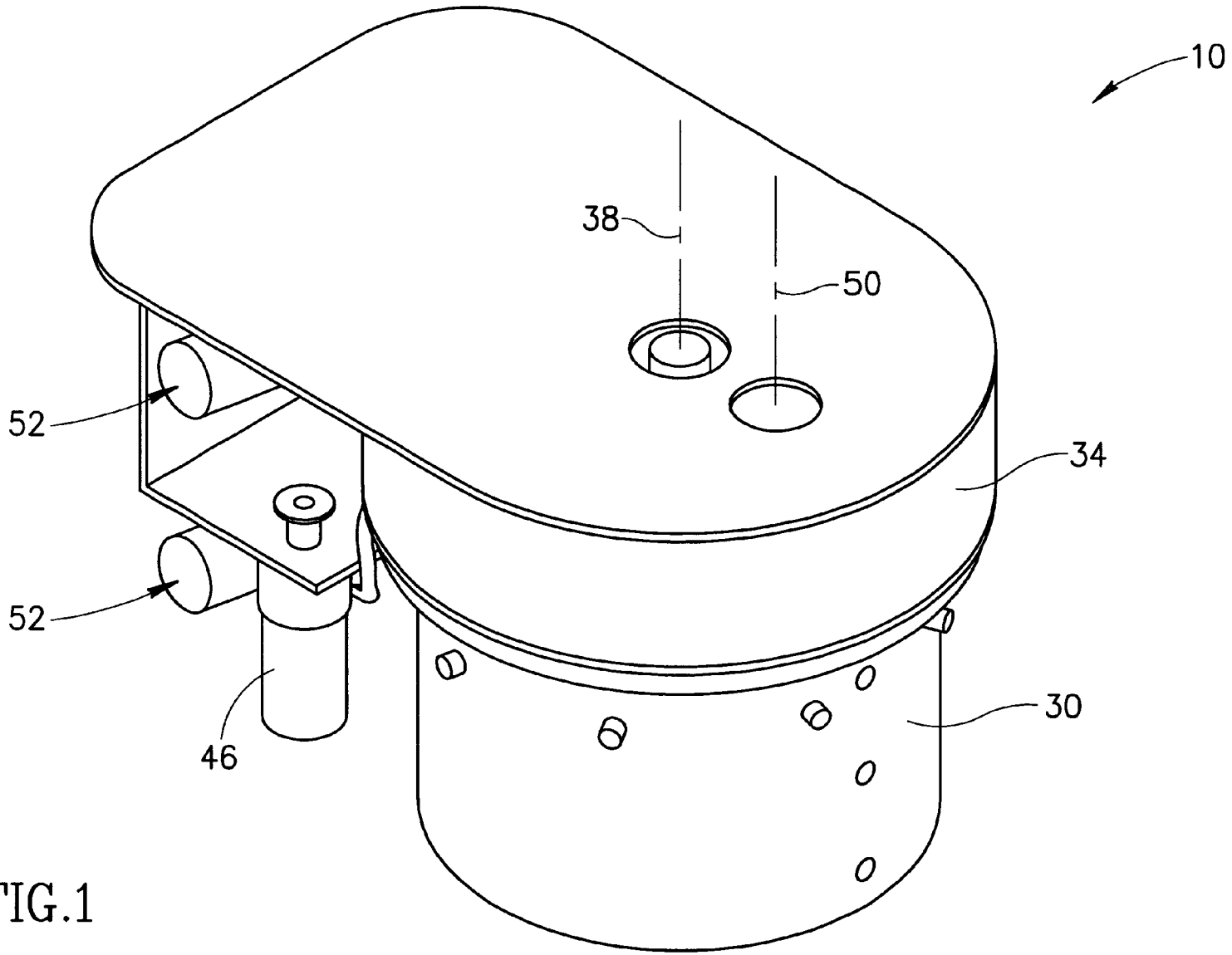
FIG. 1 is a simplified pictorial illustration of a collimator system constructed and operative in accordance with a preferred embodiment of the present invention.
Figure 2:
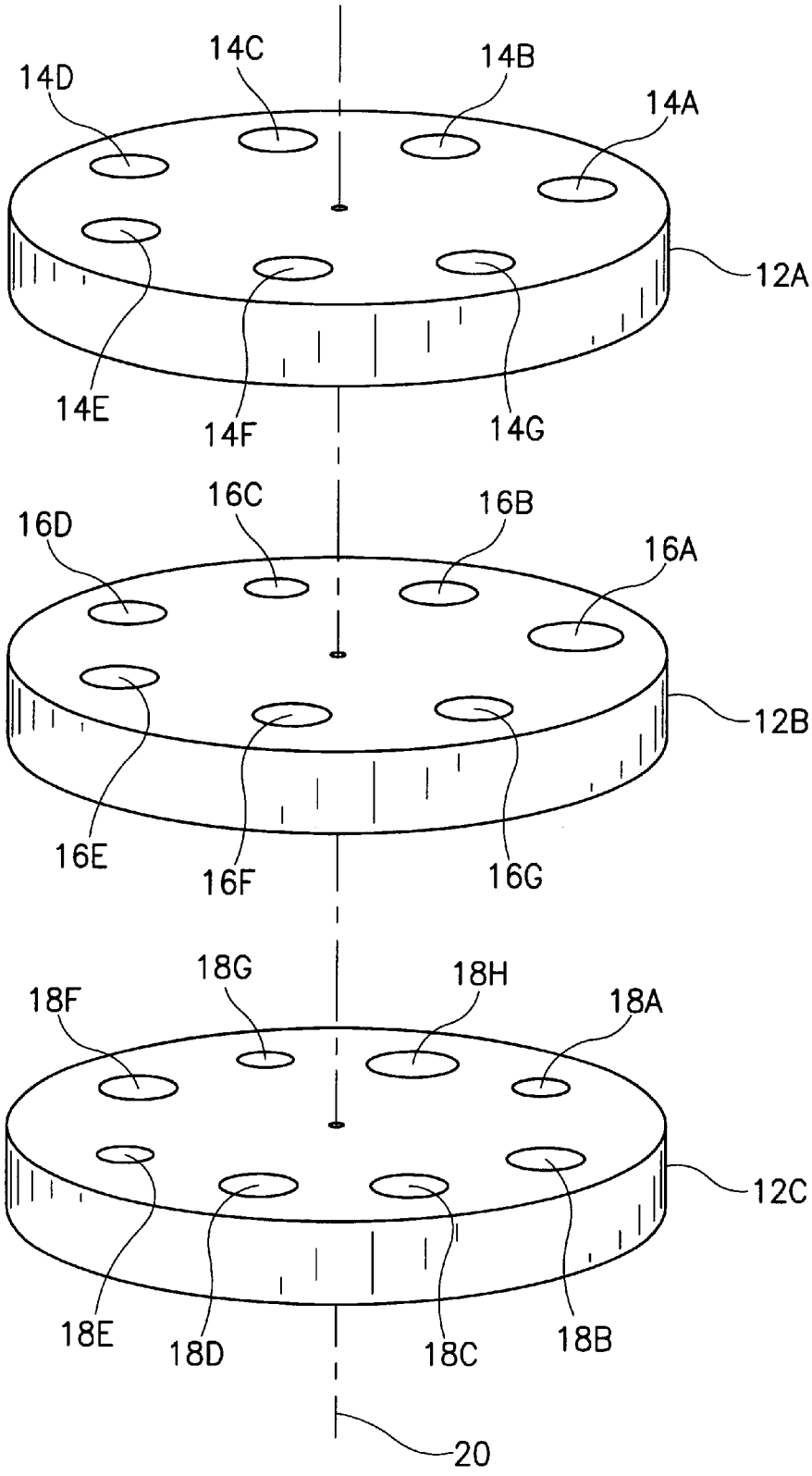
FIG. 2 is a simplified exploded illustration of three revolving plates with collimator apertures formed therein of the collimator system of FIG. 1, constructed and operative in accordance with a preferred embodiment of the present invention.

As seen best in FIG. 2, one or more collimator apertures are preferably formed in each of the plates. (For the sake of simplicity, FIG. 2 is an exploded illustration of plates 12A, 12B and 12C only.) For example, plate 12A is formed with collimator apertures 14A–14G, plate 12B is formed with collimator apertures 16A–16G, and plate 12C is formed with collimator apertures 18A–18H. The plates 12A–12H are arranged relative to each other such that the collimator apertures formed in neighboring plates are alignable with each other to form a collimation path adapted for a radiation beam to pass therethrough. Preferably plates 12A–12H are arranged to revolve about a common axis 20. Alternatively the plates can revolve about different axes.

It is noted that there is not necessarily the same amount of collimator apertures on each plate. In the example illustrated in FIG. 2, plates 12A and 12B have 7 collimator apertures each while plate 12C has 8 collimator apertures. It is appreciated that any number of collimator apertures may be formed in the plates. It is also noted that the collimator apertures of one plate may be differently sized than the collimator apertures on another of the plates. For example, collimator aperture 14G of plate 12A is smaller in diameter than collimator aperture 16A of plate 12B. Moreover, the same plate may have differently sized collimator apertures. For example, collimator aperture 18H of plate 12C is greater in diameter than collimator aperture 18A. Alternatively, one of the plates can have generally equally sized collimator apertures, such as apertures 14A–14G of plate 12A. The collimator apertures of the plates may span any diameter range, such as, but not necessarily, 5–35 mm.

As seen in FIG. 2, the plates may have different thicknesses. For example, plate 12A is thicker than plates 12B and 12C.

Figure 3:
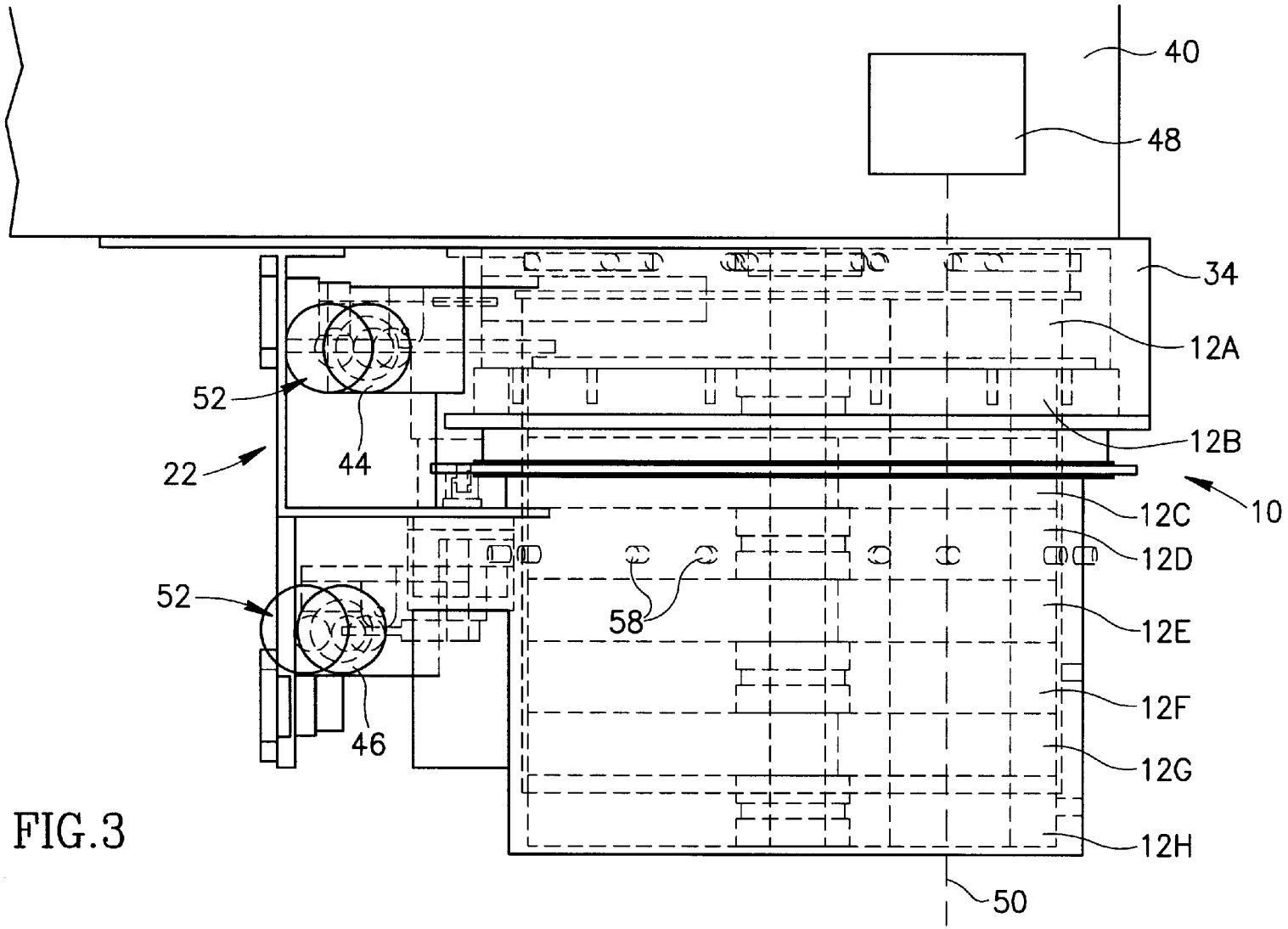
FIG. 3 is a simplified elevational section view of the collimator system of FIG. 1.
Figure 5:
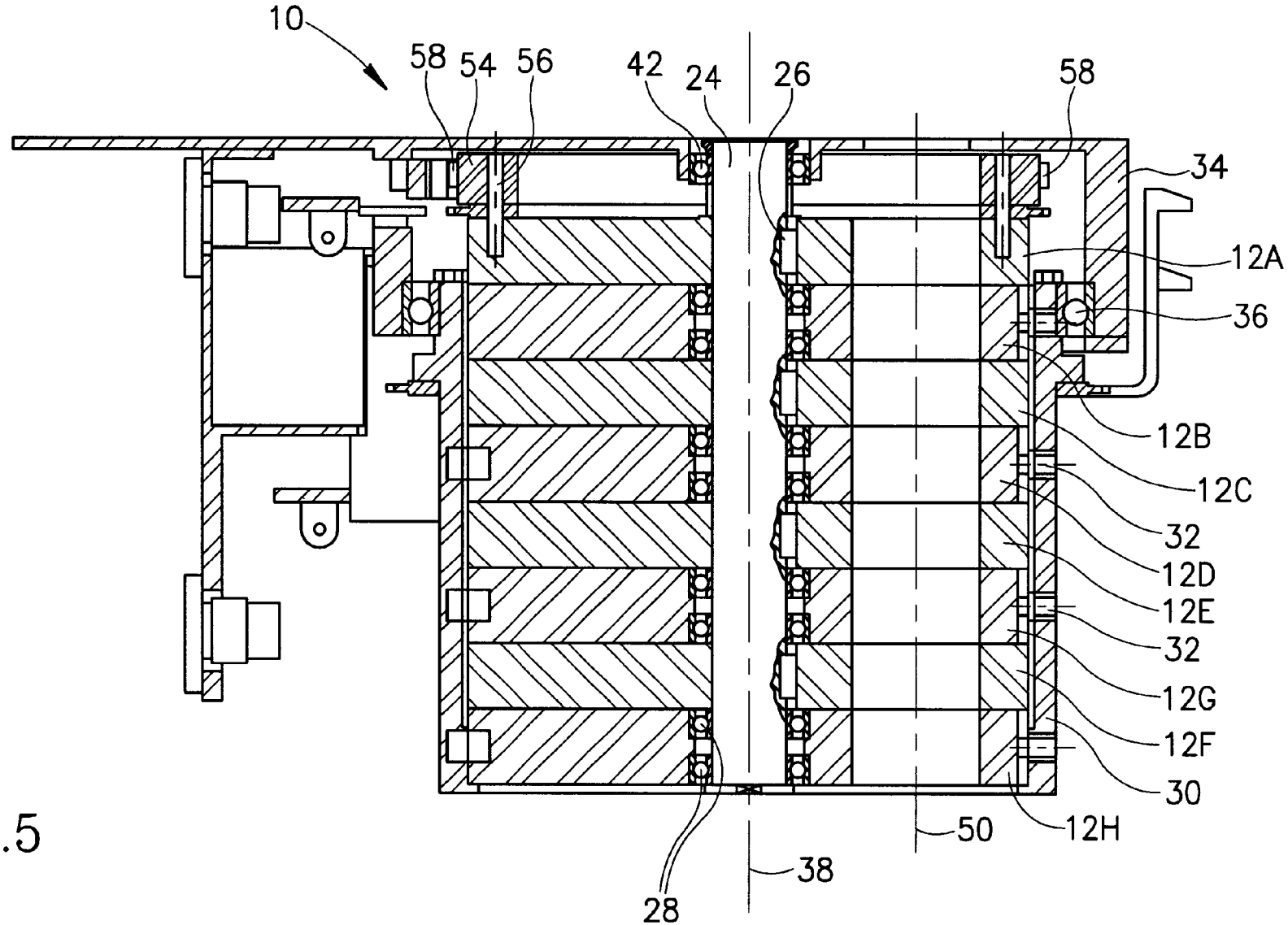
FIG. 5 is a more detailed elevational section view of the collimator system of FIG. 1.

The illustration in FIG. 2 is an exploded view of the plates. As seen in FIGS. 3 and 5, in reality the plates are closely spaced to each other. Preferably a gap between neighboring plates is sufficiently small such that a radiation beam of a desired wavelength is substantially prevented from passing through the gap.

Figure 4:
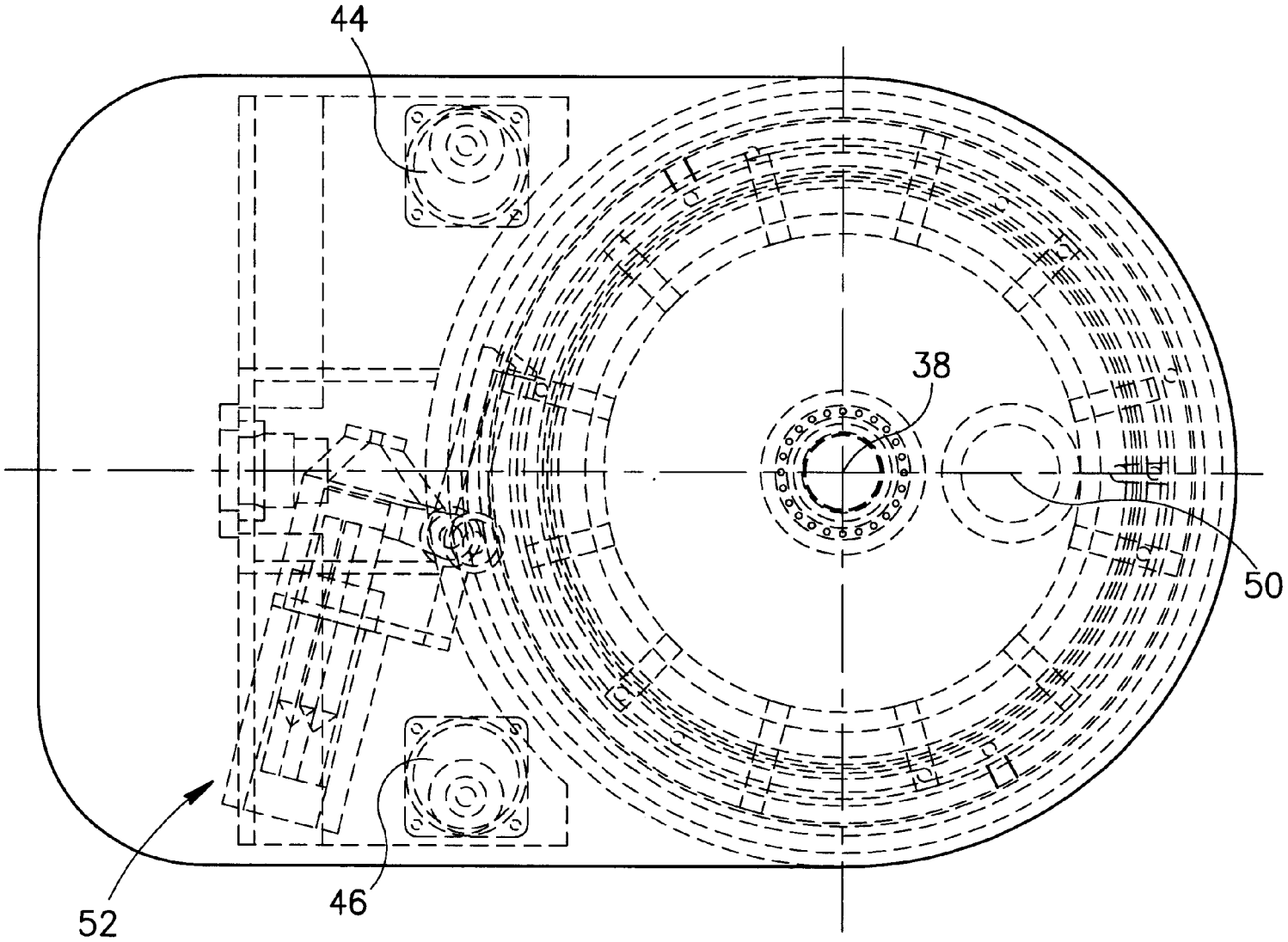
FIG. 4 is a simplified plan section view of the collimator system of FIG. 1.

In accordance with a preferred embodiment of the present invention, a controller 22 is connected to plates 12A–12H which selectively revolves the plates, as is now described with particular reference to FIGS. 3–5. It is noted that the following description is only one example of mounting and revolving the plates, and it is appreciated by persons skilled in the art that other arrangements are possible within the scope of the invention.

Plates 12A, 12C, 12E and 12G are preferably securely mounted to a central axle 24 such as by means of keys 26 (FIG. 5). Plates 12B, 12D, 12F and 12H are preferably mounted on bearings 28 about the common axle 24 and are each fastened to a drum 30, such as by means of pins 32. Drum 30 is mounted to a support base 34 by means of another bearing 36. In this manner, plates 12B, 12D, 12F and 12H can rotate together with drum 30 about a longitudinal axis 38 of axle 24. Support base 34 remains stationary and can be fastened to a gantry arm 40 (FIG. 3) of a radiotherapy system. Axle 24 is preferably mounted to base 34 by means of yet another bearing 42. In this manner, plates 12A, 12C, 12E and 12G can rotate together with axle 24 about longitudinal axis 38. Plates 12A, 12C, 12E and 12G thus rotate about axis 33 independently of plates 12B, 12D, 12F and 12H.

Controller 22 preferably includes a servomotor 44 linked by means of wearing, timing belt or any other suitable linkage, to plate 12A and another servomotor 46 linked similarly to drum 30 or one of plates 12B, 12D, 12F and 12H. Servomotor 44 controls rotation of plates 12A, 12C, 12E and 12G, and servomotor 46 controls rotation of plates 12B, 12D, 12F and 12H. (In FIG. 5 the servomotors are not shown for the sake of clarity.) The plates can be rotated so as to align any selected plurality of collimator apertures with a source of radiation 48 (FIG. 3). A radiation beam 50 (FIG. 3) thus passes through and is collimated by the aligned collimator apertures.

Figure 6:
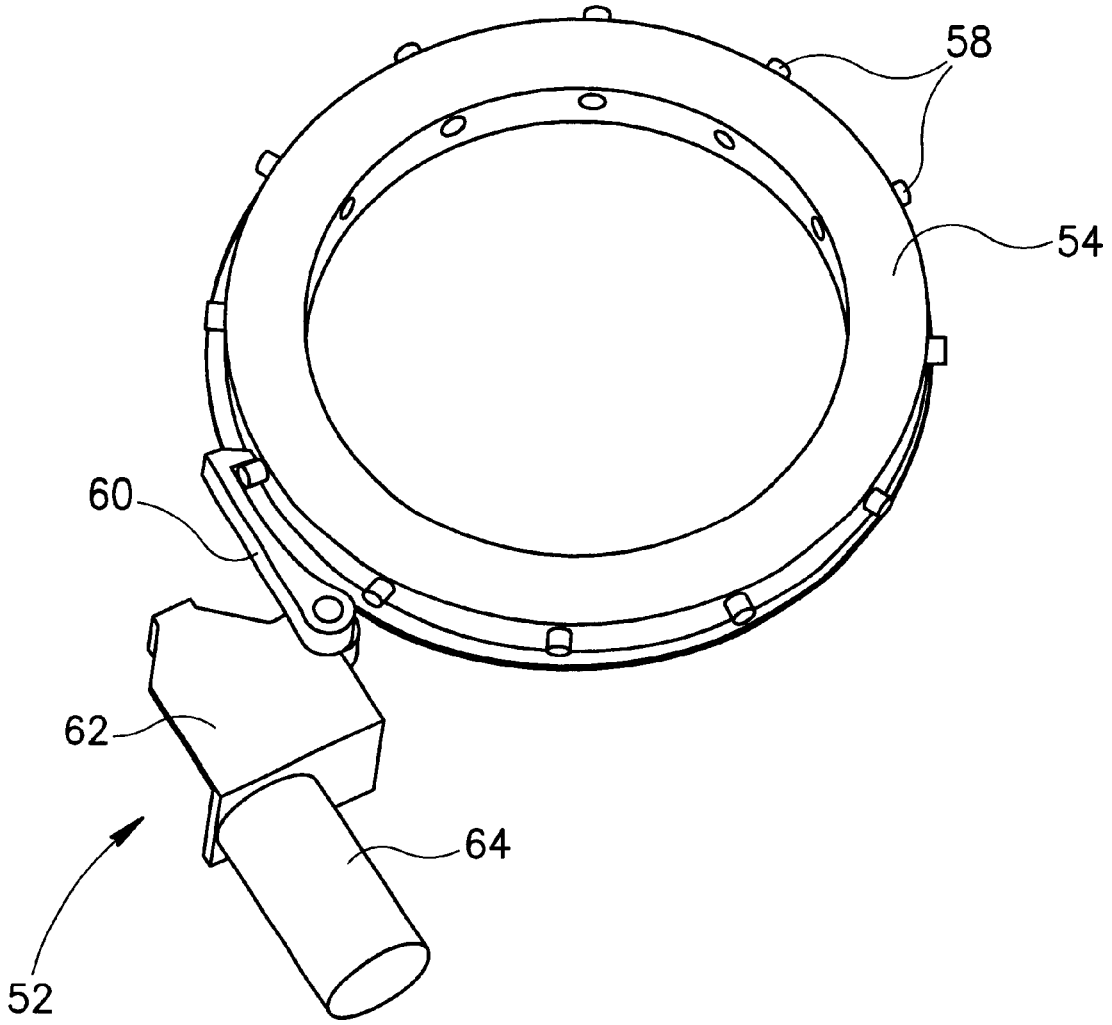
FIG. 6 is a simplified pictorial illustration of a stop mechanism useful with the collimator system of FIG. 1, constructed and operative in accordance with a preferred embodiment of the present invention.

Reference is now additionally made to FIG. 6 which illustrates a stop mechanism 52 which selectively arrests rotational movement of the plates. A ring 54 is preferably attached to plate 12A by means of fasteners 56. Ring 54 has a plurality of pegs 58 radially protruding therefrom. A pawl 60 is pivotally mounted to a bracket 62 and is actuated by a motor or actuator 64. Pawl 60 selectively catches one of the pegs 58 and thereby arrests rotational movement of ring 54, as well as plates 12A, 12C, 12E and 12G which are mechanically linked with ring 54.

In a similar fashion, pegs 58 may be mounted on one of plates 12B, 12D, 12F and 12K, such as plate 12D, and another pawl may be used to arrest rotational movement thereof. (In FIG. 5 the stop mechanisms are not shown for the sake of clarity.)

It is appreciated that although the best mode of carrying out the present invention employs revolvable plates, nevertheless the plates can alternatively be movable linearly with respect to each other.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A collimator system comprising:

a plurality of movable plates stacked one above another, said plates being constructed of a material substantially impervious to passage therethrough of radiation in a predetermined range of wavelengths; and at least one collimator aperture formed in each of said plates, wherein each of said plates is independently rotatable about a common axis.

2. The collimator system according to claim 1 wherein said plates are arranged relative to each other such that said collimator apertures formed in neighboring plates are alignable with each other to form a collimation path adapted for a radiation beam to pass therethrough.

3. The collimator system according to claim 1 wherein one of said collimator apertures on one of said plates has a different sized opening than a collimator aperture on another of said plates.

4. The collimator system according to claim 1 wherein at least one of said plates is formed with a plurality of differently sized collimator apertures.

5. The collimator system according to claim 1 wherein at least one of said plates is formed with a plurality of generally equally sized collimator apertures.

6. The collimator system according to claim 1 wherein a gap between neighboring plates of said plurality of movable plates is sufficiently small such that a radiation beam of a predetermined wavelength is substantially prevented from passing through said gap.

7. The collimator system according to claim 1 further comprising a controller connected to said plates which selectively revolves said plates.

8. The collimator system according to claim 7 wherein said controller comprises a servomotor linked to said plates which selectively revolves said plates.

9. The collimator system according to claim 1 wherein a subset of said plates are mechanically linked together and are mounted on bearings about a common axle, such that said subset of plates revolves together independently of the other plates.

10. The collimator system according to claim 1 further comprising a stop mechanism which selectively arrests movement of said plates.

11. A collimator system comprising:

a plurality of movable plates stacked one above another, said plates being constructed of a material substantially impervious to passage therethrough of radiation in a predetermined range of wavelengths; and at least one collimator aperture formed in each of said plates, wherein at least one of said plates has a thickness different from another of said plates.

* * * * *